US005618097A

United States Patent [19]

Coushaine

[11] Patent Number: 5,618,097

[45] Date of Patent: Apr. 8, 1997

[54] ELECTRIC LAMP WITH A VARIABLY KEYED BASED

[75] Inventor: Charles M. Coushaine, Rindge, N.H.

[73] Assignee: Osram Sylvania Inc., Danvers, Mass.

[21] Appl. No.: 520,850

[22] Filed: Aug. 30, 1995

[51] Int. Cl.[6] ..... H01R 13/74

[52] U.S. Cl. ..... 362/61; 362/80; 362/285; 439/546; 403/3; 403/349

[58] Field of Search ..... 362/61, 80, 285; 439/549, 550, 544, 541, 546, 547, 548, 57; 403/3, 4, 349

[56] References Cited

U.S. PATENT DOCUMENTS 4,427,255 1/1984 Cox ..... 439/617
4,557,513 12/1985 Ferrieri ..... 403/3
4,893,218 1/1990 Dilk et al. ..... 362/61
5,115,381 5/1992 Van Heeswijk ..... 362/285
5,361,191 11/1994 Matsuzaki et al. ..... 362/61
5,402,325 3/1995 Wisler et al. ..... 362/61

*Primary Examiner*—Ira S. Lazarus
*Assistant Examiner*—Sara Sachie Raab
*Attorney, Agent, or Firm*—Wolf, Greenfield & Sacks, P.C.

[57] ABSTRACT

A keyed lamp assembly includes an electric lamp and a lamp base secured to the electric lamp for electrical connection to the lamp and for mounting the lamp in a keyed lamp fixture. The lamp base includes a lamp base body and at least one fixed key on the lamp base body. The lamp assembly further includes a movable key on a key carrier that is movable to two or more different positions on the lamp base body during manufacturing. The key carrier is attached to the lamp base body in one of the positions such that the fixed and movable keys provide variable keying of the lamp assembly. The lamp base body and the key carrier may have interengaging ratchet elements for defining discrete positions of the movable key.

17 Claims, 4 Drawing Sheets

ELECTRIC LAMP WITH A VARIABLY KEYED BASED

FIELD OF THE INVENTION

This invention relates to electric lamp assemblies which are keyed to ensure proper installation and, more particularly, to electric lamp assemblies which have a key that is movable during manufacturing to provide different key configurations.

BACKGROUND OF THE INVENTION

Electric lamp assemblies and lamp fixtures, such as reflectors, are commonly keyed to prevent installation of the lamp assembly in a lamp fixture to which it is not properly matched. Keying is necessary because many lamps are similar in appearance and may be installed by unskilled persons, thus increasing the risk of improper installation. For example, vehicle headlamps may be keyed to ensure that lamps with the required characteristics are installed in the headlamp reflector. A keyed lamp base may include one or more projections of prescribed sizes and locations, which engage matching notches in the reflector during installation. When the lamp base does not have the required key configuration, it cannot be installed in the reflector.

In some cases, two or more lamp types may be used in the same or similar fixtures. For example, lamps with different wattages may be used in a vehicle fog lamp reflector. Installation of a lamp with the wrong wattage in the reflector may have adverse consequences. The light output may be inadequate, the life of the lamp may be shortened, or the lamp power source may be overloaded. Thus, the lamp assembly must be keyed to prevent it from being installed in a reflector to which it is not matched.

One approach is to simply provide a lamp base with a different key configuration for each possible lamp that may be used in the reflector. However, this approach is relatively expensive and inconvenient. Lamp bases are typically molded plastic. The initial tooling costs for multiple different lamp base configurations may be prohibitive. In addition, it would be necessary to stock multiple lamp base configurations. It is therefore desirable to provide a lamp base having variable keying for multiple lamp configurations, while overcoming the difficulties of manufacturing and stocking multiple lamp base configurations.

SUMMARY OF THE INVENTION

According to the present invention, a keyed lamp assembly is provided. The lamp assembly comprises an electric lamp and a lamp base secured to the electric lamp for electrical connection to the lamp and for mounting the lamp in a keyed lamp fixture. The lamp base includes a lamp base body and at least one fixed key on the lamp base body. The lamp assembly further includes a movable key on a key carrier that is movable to two or more different positions on the lamp base body during manufacturing. The key carrier is attached to the lamp base body in one of the positions such that the fixed and movable keys provide variable keying of the lamp assembly. The lamp assembly may, for example, comprise a fog lamp assembly for mounting in a fog lamp reflector on a vehicle.

In a preferred embodiment, the key carrier comprises a split ring that engages the lamp base body and is rotatable with respect to a central axis of the lamp base body during manufacturing. The key carrier may be rotatable between two or more discrete positions. The lamp base body and the key carrier may have interengaging ratchet elements for defining the discrete positions. When the movable key is in a desired position, the key carrier is attached to the lamp base body, for example, by an adhesive, by heat staking or by ultrasonic welding.

The movable key may be axially offset from the key carrier so that the fixed and movable keys are axially aligned in the lamp assembly. The lamp base body may be provided with an opening for receiving the movable key. The opening may be dimensioned to limit rotation of the movable key during manufacturing to a selected number of positions.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
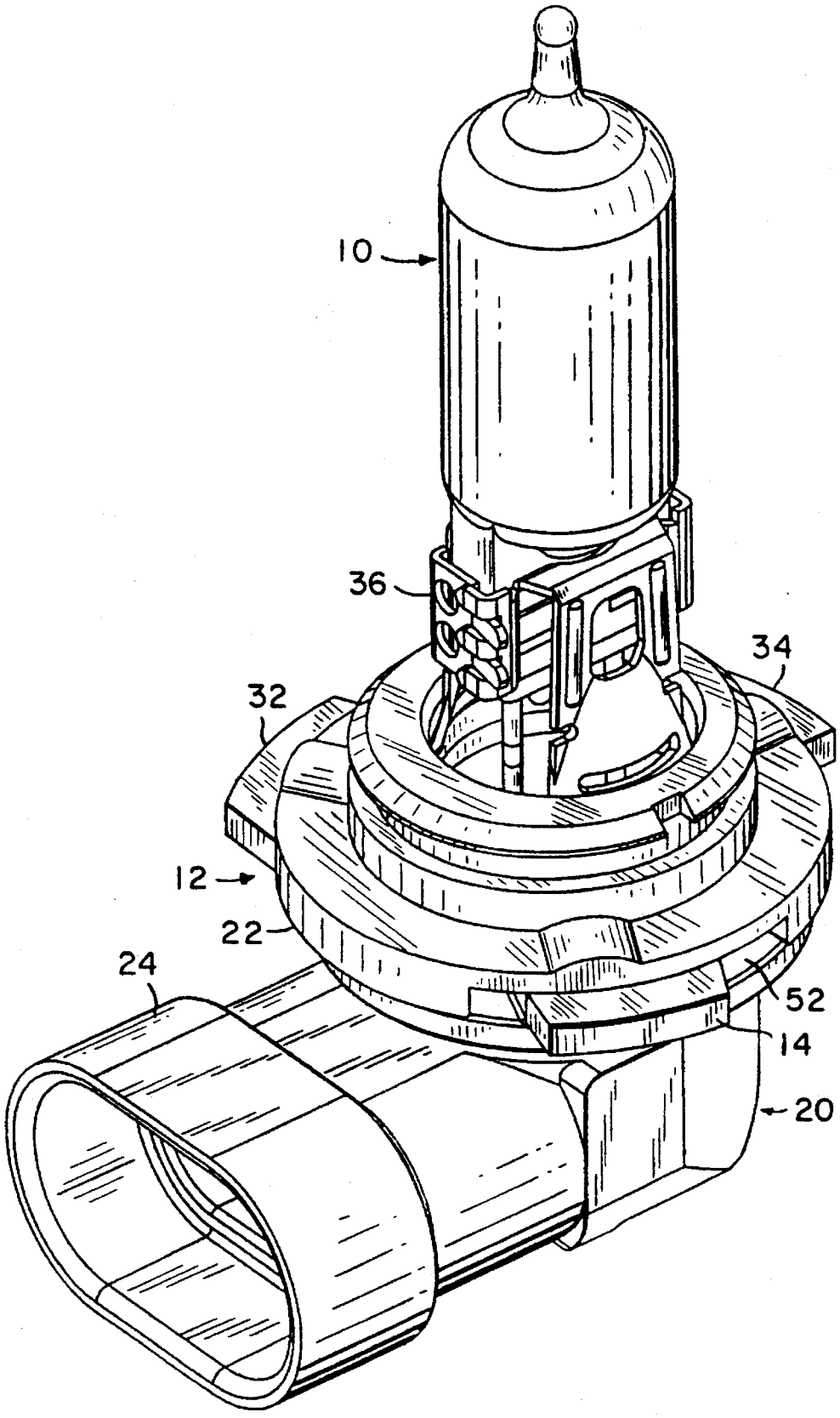
FIG. 1 is a perspective view of a lamp assembly in accordance with the present invention.
Figure 2:
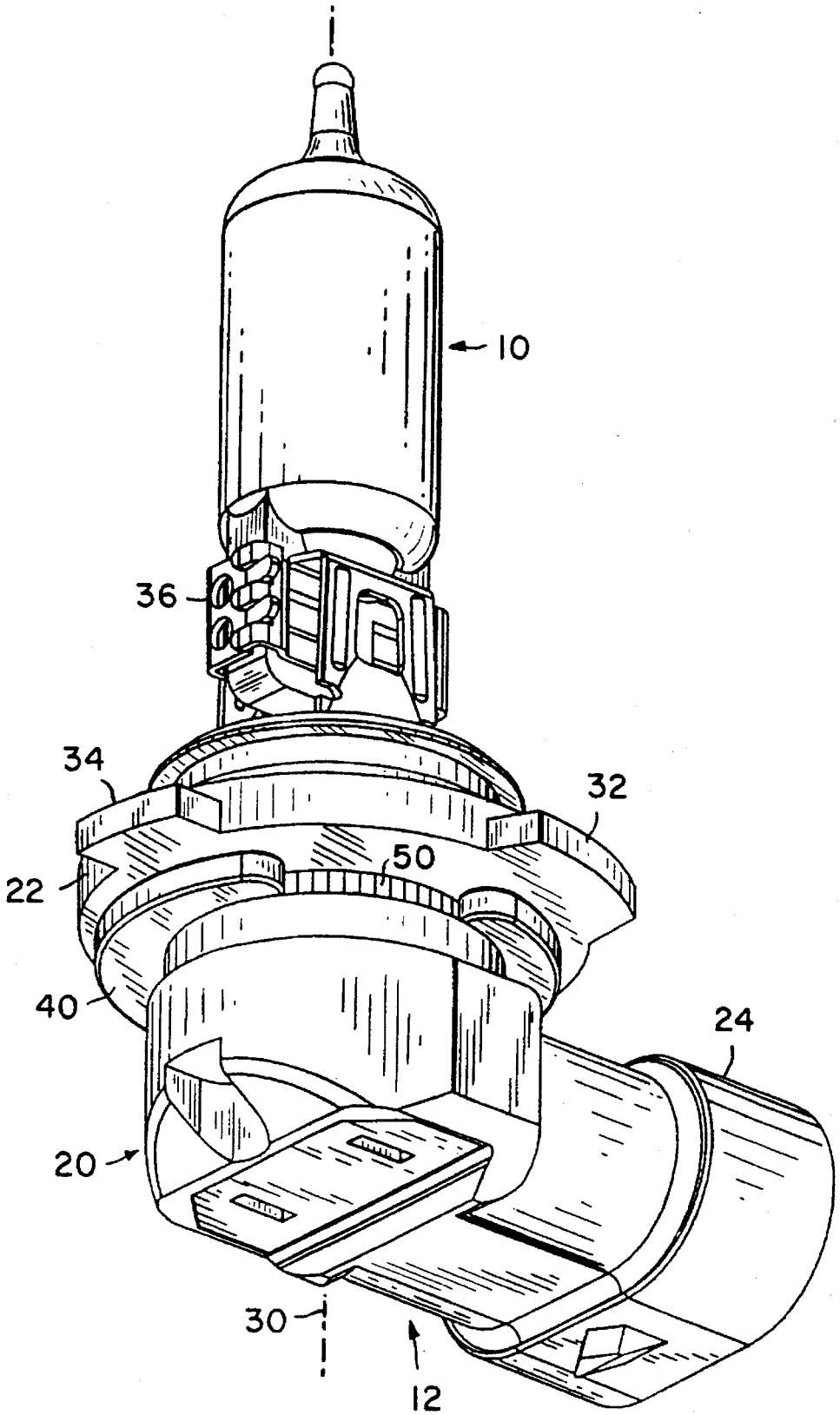
FIG. 2 is a perspective view of the lamp assembly of FIG. 1, taken from the opposite direction.
Figure 3:
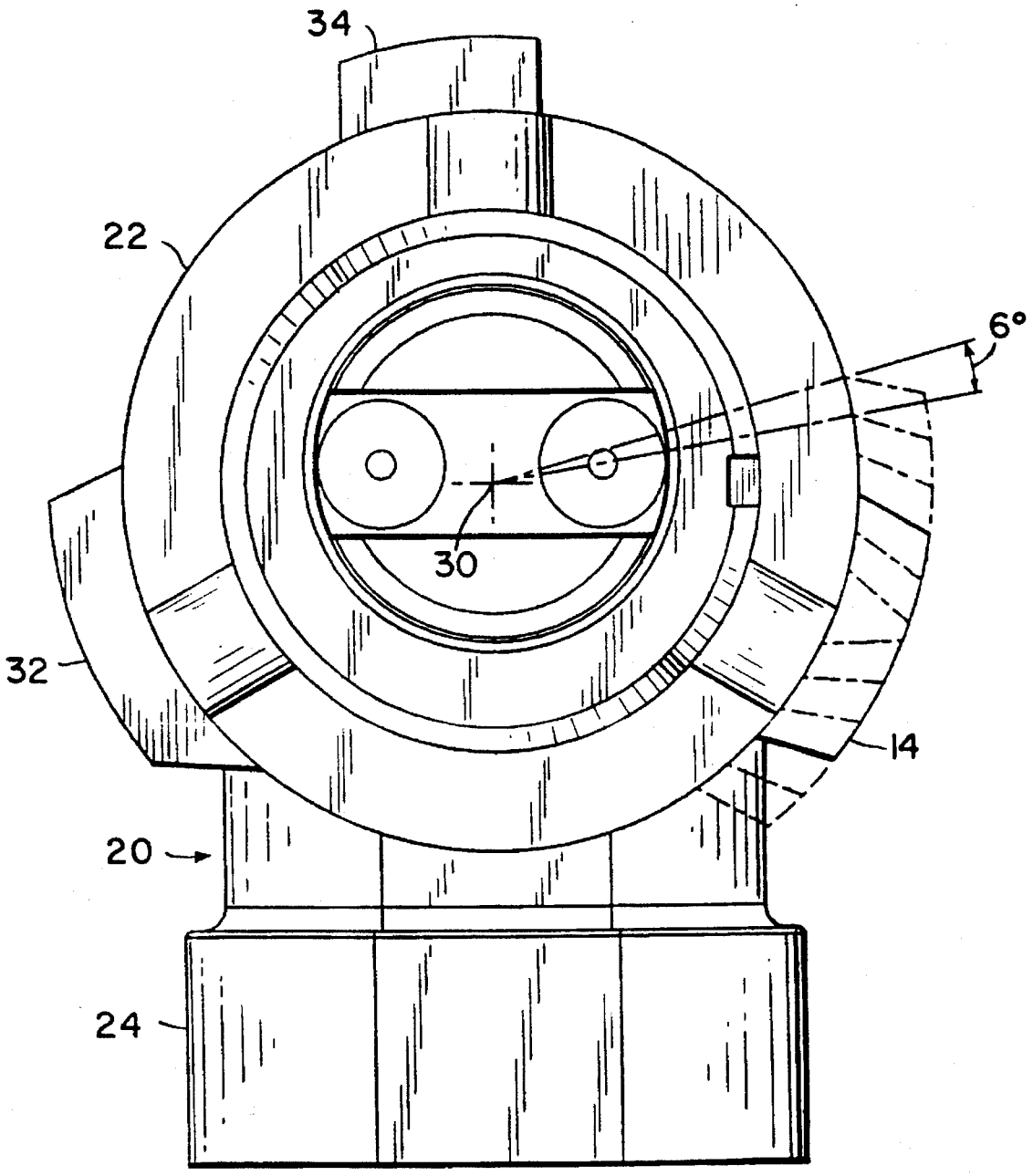
FIG. 3 is a bottom view of the lamp assembly of FIG. 1.

An example of a lamp assembly in accordance with the present invention is shown in FIGS. 1–3. An electric lamp 10 is mounted in a lamp base 12, which is shown separately in FIG. 4. The lamp base 12 is utilized for electrical connection to lamp 10 and for mechanical mounting of lamp 10 in a keyed lamp fixture such as a reflector. In addition, the lamp base includes keying to ensure that the lamp assembly can only be installed in a lamp fixture, such as a reflector, to which it is matched. The lamp assembly further includes a movable key 14 as described below. The lamp assembly shown in FIGS. 1–3 is similar to a type 9006 headlamp, but includes variable keying in accordance with the present invention.

The lamp base 12 is typically molded of a high temperature plastic and includes a lamp base body 20 having a key portion 22 and a connector portion 24. The connector portion 24 is of conventional design and may have a right angle configuration as shown in FIGS. 1–4. In other embodiments, the connector portion of the lamp base may have a straight configuration or any other suitable configuration. The key portion 22 of lamp base body 20 may be generally circular in shape and have a central axis 30 that is coaxial with the central axis of electric lamp 10. Fixed keys 32 and 34 extend radially outwardly from lamp base body 20. Each of the fixed keys 32 and 34 is typically an integrally molded part of lamp base body 20 and may have the form of a radially-extending tab or projection. The fixed keys 32 and 34 are located at different circumferential positions on the key portion 22 of lamp base body 20.

The lamp 10 may be mounted in lamp base 12 using a conventional mounting structure, including a metal clamp 36 that is secured to a press seal portion of the lamp envelope. Contact pins of the lamp 10 extend into the lamp base 12 and are electrically connected to conductors of connector portion 24. The lamp 10 may, for example, be a quartz halogen lamp capsule. However, different lamp types and different lamp mounting structures may be utilized within the scope of the present invention.

The keying of the lamp base 12 is established by movable key 14 and fixed keys 32 and 34. The keying parameters include the number of keys on the lamp base 12, the angular spacing between keys with respect to central axis 30, and the size and shape of each individual key. Each key is matched as to size, shape and location with a corresponding notch or recess on the lamp fixture in which the lamp assembly is to be installed. A lamp assembly in accordance with the present invention includes at least one fixed key and at least one movable key.

Figure 5:
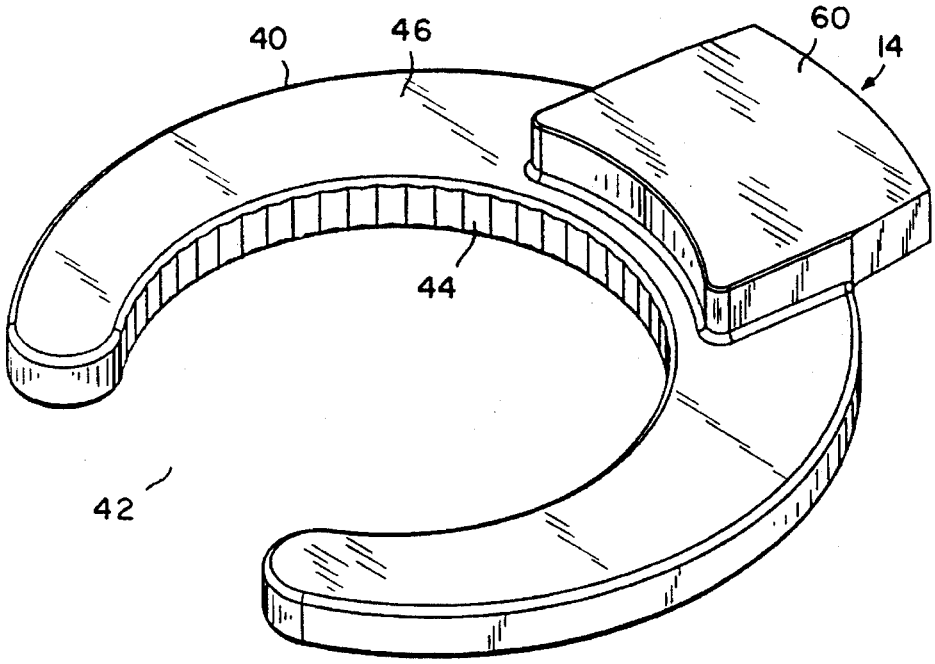
FIG. 5 is a perspective view of the movable key and key carrier.

As best shown in FIG. 5, the movable key 14 is attached to a key carrier 40, which provides a mechanical connection between movable key 14 and lamp base body 20. The key carrier 40 may comprise a split ring having an opening 42, an inside surface 44 and a top surface 46. The movable key 14 is preferably formed on top surface 46 so that it is axially offset from key carrier 40. In a preferred embodiment, the movable key 14 and the key carrier 40 are integrally molded of a high temperature plastic. The inside surface 44 may have ratchet elements, such as ratchet teeth or flats, which define discrete positions of the movable key 14.

Figure 4:
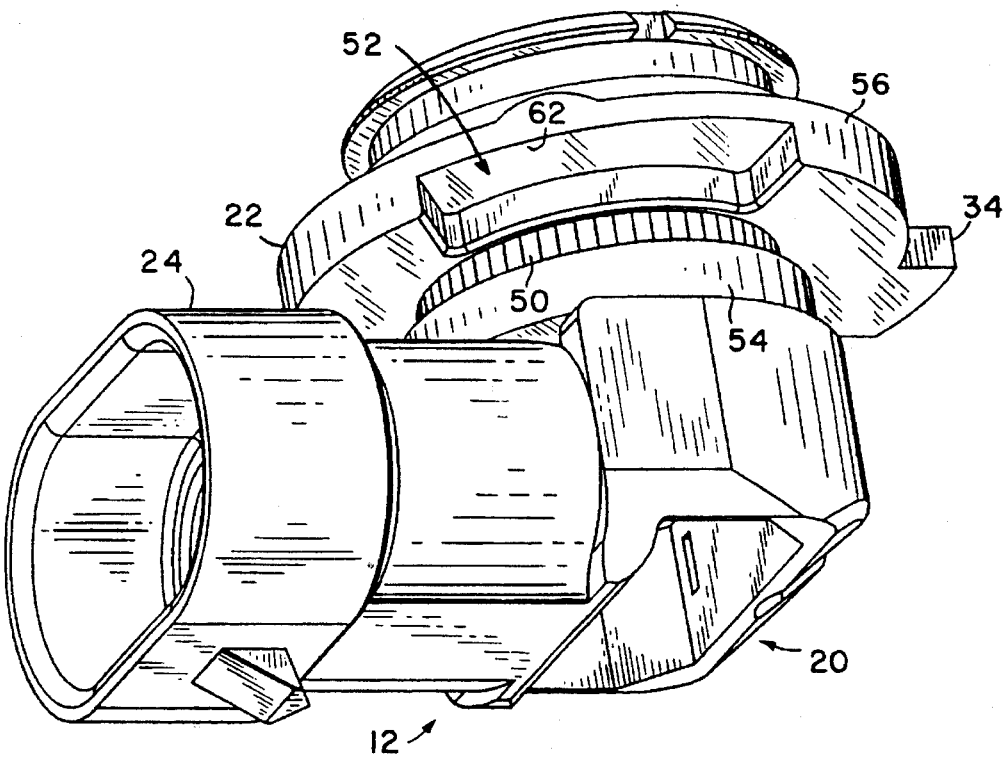
FIG. 4 is a perspective view of the lamp base shown in FIG. 1.

As best shown in FIGS. 2 and 4, the key portion 22 of lamp base body 20 is provided with a generally circular surface 50 that is coaxial with axis 30. The surface 50 may be axially offset from fixed keys 32 and 34 and may have ratchet elements, such as ratchet teeth or flats. During manufacturing, the key carrier 40 is snapped onto the lamp base body with its inside surface 44 engaging surface 50 of lamp base body 20. Portions 54 and 56 of lamp base body 20 on opposite sides of surface 50 are larger in diameter than surface 50, thus defining a groove in the lamp base body. The portions 54 and 56 axially locate the key carrier 40 with respect to the lamp base body. The lamp base body may further include an opening 52 for receiving movable key 14. The opening 52 is axially aligned with fixed keys 32 and 34. When the key carrier 40 is positioned on surface 50 of lamp base body 20, the movable key 14 is located in opening 52. Preferably, the opening 52 is dimensioned to limit the rotation of movable key 14 to a selected number of possible positions of movable key 14. The opening 52 may be generally arc shaped so as to define a range of rotation of movable key 14.

As indicated, the inside surface 44 of key carrier 40 and the circular surface 50 may have ratchet elements which define discrete positions of movable key 14. The ratchet elements may be in the form of ratchet teeth, flats or any other suitable ratchet configuration. In one embodiment, the surface 50 has a six-degree spacing between adjacent ratchet elements as shown in FIG. 3. The opening 52 limits the possible positions of movable key 14 to six positions separated by six degrees. It will be understood that different angular separations between key positions may be utilized, and different numbers of key positions may be selected. The spacing between adjacent key positions should be sufficient to prevent installation of the lamp assembly in the wrong lamp fixture. The number of key positions depends on the number of lamp types that may be utilized in the lamp base.

After the key carrier 40 has been snapped onto the lamp base body 20 and rotated, if necessary, to the desired angular position, it is secured in position by an adhesive, heat staking, ultrasonic welding, or any other suitable technique for attaching the parts together. For example, surface 60 of movable key 14 (FIG. 5) may be attached to surface 62 of lamp base body 20 (FIG. 4) adjacent to opening 52 by one of the above-described techniques. The lamp assembly is thereby permanently keyed and may be installed only in a reflector or other lamp fixture having a key configuration that matches the keying of the lamp base. It will be understood that the movable key 14 remains fixed in position after completion of manufacturing so as to define a fixed key configuration.

Because the movable key 14 is movable between selected key positions during manufacturing, a number of different lamp configurations can be established with a single lamp base and movable key. Thus, molding of multiple lamp base configurations is not required. Only two lamp base parts must be stocked to produce multiple lamp base key configurations.

It will be understood that the movable key 14 and the fixed keys 32 and 34 may have different configurations within the scope of the present invention. For example, the lamp assembly may include one or more fixed keys and one or more movable keys. The key carrier 40 may have any configuration that is suitable for attachment of the movable key to the lamp base body. The movable key may have different sizes and shapes. Ratchet elements are not necessarily required for defining discrete positions of the movable key. The inside surface 44 of key carrier 40 and the circular surface 50 of lamp base body 20 may be smooth, so that the movable key may be continuously rotated within a prescribed angular range established by opening 52.

In one application of the present invention, the lamp assembly is utilized in a fog lamp for a vehicle. The lamp assembly is mounted in a keyed fog lamp reflector. The keying of the lamp assembly may correspond to different wattages. For example, the fog lamp may have multiple wattages between 25 and 100 watts, each of which corresponds to a different key configuration.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A keyed lamp assembly comprising:

an electric lamp;

a lamp base secured to said electric lamp for electrical connection to said lamp and for mounting said lamp in a keyed lamp fixture, said lamp base including a lamp base body and a fixed key on said lamp base body; and a movable key on a key carrier that is movable to at least two different positions on said lamp base body during manufacturing and is attached to said lamp base body in one of said different positions, such that said fixed and movable keys provide variable keying of said lamp assembly.

2. A keyed lamp assembly as defined in claim 1 wherein said key carrier comprises a split ring that engages said lamp base body and is rotatable with respect to said lamp base body during manufacturing.

3. A keyed lamp assembly as defined in claim 1 wherein said lamp base body includes a generally circular surface and said key carrier comprises a split ring that engages said circular surface and is rotatable with respect to said circular surface during manufacturing.

4. A keyed lamp assembly as defined in claim 3 wherein said key carrier is rotatable between discrete positions during manufacturing.

5. A keyed lamp assembly as defined in claim 4 wherein said lamp base body and said key carrier have interengaging ratchet elements for defining said discrete positions.

6. A keyed lamp assembly as defined in claim 5 wherein said interengaging ratchet elements are formed on the circular surface of said lamp base body and on an inside surface of said key carrier.

7. A keyed lamp assembly as defined in claim 3 wherein said lamp base body has a central axis and wherein said key carrier is rotatable about said central axis.

8. A keyed lamp assembly as defined in claim 7 wherein said movable key is axially offset from said key carrier, such that said fixed and movable keys are axially aligned.

9. A keyed lamp assembly as defined in claim 8 wherein said lamp base body includes an opening for receiving said movable key, said opening being dimensioned to limit rotation of said movable key between a predetermined number of discrete positions during manufacturing.

10. A keyed lamp assembly as defined in claim 7 wherein said lamp base further includes a second fixed key on said lamp base body.

11. A keyed lamp assembly as defined in claim 10 wherein said fixed and movable keys each comprise a tab that extends radially outwardly from said lamp base body.

12. A fog lamp assembly for mounting in a keyed fog lamp reflector, comprising:

an electric lamp;

a lamp base secured to said electric lamp for electrical connection to said lamp and for mounting said lamp in said fog lamp reflector, said lamp base including a lamp base body having a central axis and at least one fixed key on said lamp base body; and a movable key on a key carrier attached to said lamp base body, said movable key and said key carrier being rotatable about said central axis to a selected position during manufacturing, such that said fixed and movable keys provide variable keying of said fog lamp assembly.

13. A fog lamp assembly as defined in claim 12 wherein said key carrier is rotatable between two or more discrete positions during manufacturing.

14. A fog lamp assembly as defined in claim 13 wherein said lamp base body and said key carrier have interengaging ratchet elements for defining said discrete positions.

15. A fog lamp assembly as defined in claim 14 wherein said lamp base body includes a generally circular surface and said key carrier comprises a split ring that engages said circular surface and is rotatable with respect to said circular surface during manufacturing.

16. A fog lamp assembly as defined in claim 15 wherein said movable key is axially offset from said key carrier and is axially aligned with said fixed key.

17. A fog lamp assembly as defined in claim 16 wherein said fixed key and said movable key each comprises a tab that extends radially outwardly from said lamp base body.

* * * * *